US012295469B1

(12) United States Patent
Adelmann-Schemberger

(10) Patent No.: US 12,295,469 B1
(45) Date of Patent: May 13, 2025

(54) MULTI-POSITIONAL CLIP ACCESSORY

(71) Applicant: Linda Jane Adelmann-Schemberger, Allen, TX (US)

(72) Inventor: Linda Jane Adelmann-Schemberger, Allen, TX (US)

( * ) Notice: Subject to any disclaimer, the term of this patent is extended or adjusted under 35 U.S.C. 154(b) by 0 days.

(21) Appl. No.: 18/403,698

(22) Filed: Jan. 3, 2024

(51) Int. Cl.
*A45C 11/00* (2006.01)

(52) U.S. Cl.
CPC ..... *A45C 11/00* (2013.01); *A45C 2011/002* (2013.01); *A45C 2200/15* (2013.01)

(58) Field of Classification Search
CPC ..... A45C 11/00; A45C 2011/002; A45C 2200/15
USPC ..... 206/45.24, 320; 24/326, 327, 457, 489, 24/499, 331, 338; 248/205.6, 206.2, 146, 248/150, 154
See application file for complete search history.

(56) References Cited

U.S. PATENT DOCUMENTS

2002/0083558 A1* 7/2002 Tsou ..... H04B 1/3888 24/3.12
2009/0229093 A1* 9/2009 Zwanenburg ..... B60R 9/06 24/517
2014/0338160 A1* 11/2014 Chien ..... F16B 2/245 24/530
2015/0382489 A1* 12/2015 Sorensen ..... F16M 11/04 24/3.1

* cited by examiner

*Primary Examiner* — Jacob K Ackun
(74) *Attorney, Agent, or Firm* — Michael A. Mochinski

(57) ABSTRACT

A multi-positional clip accessory for use with electronic and non-electronic devices to facilitate handling thereof, organizing wires, and hanging personal articles, which includes a base configured with a cylindrical support having an interior cylindrical chamber for housing therein a rotatable rod with first and second ends affixed to first and second pivoting arms, with each respectively including a catch that interacts with a free end of a spring clip and a pair of inline apertures for accepting terminal ends of the spring clip. The rotatable rod incudes splines geometrically corresponding to linear grooves configured within semi-radial sidewalls of the interior cylindrical chamber, whereby movement of the pivoting arms effects rotation of the rotatable rod within the interior cylindrical chamber while simultaneously expanding the semi-radial sidewalls outwardly as the splines release from their mating relation with the linear grooves and re-engage with neighboring linear grooves to establish an altered angular relationship of the pivoting arms.

20 Claims, 10 Drawing Sheets

MULTI-POSITIONAL CLIP ACCESSORY

FIELD OF THE INVENTION

The present invention is largely directed to a multi-positional clip accessory for readily attaching to and detaching from portable electronic devices generally in the form of a cellular telephone or tablet, notably of which fulfills secure handling thereof as well as serving as an adjustable, supportable stand to enable viewing of contextual matter on the device's accompanying display. Further, the multi-positional clip accessory may be used alternatively as a supportable stand for non-electronic devices, such as a book, paper pad and so forth, when used conjunctively with and attached to a modestly-sized planar element, or as a securement device for routing and supporting electrical cords and so forth along a wall surface, for example.

BACKGROUND OF THE INVENTION

Electronic devices in the form of cellular telephones, electronic tablets, gaming devices, and so forth are ubiquitous in today's modern society, and in some instances, have technologically advanced in terms of computing power to replace the modern-day desktop computer. As often observed over the course of time, technological advancements have equally miniaturized many forms of these electronic devices to extent of allowing the individual user to handle and manage the device simply with one's own hand, and some cases, a finger. Although beneficial to many, the device's smaller form factor may present challenges for safe handling thereof, particularly in instances of hurried and inattentive use of the device, for example. Unavoidable slippage or dropping of the device from one's hand and landing awkwardly onto the ground's surface, such as on its corner, may unfortunately result in costly repairs, and in extreme cases, a non-repairable, non-functioning device. In addressing this issue, as well as others, the device may be typically accessorized with a handle in the preferential form of an adjustable prop, a ring, an outward arm, a pop-up extension, a foldable extending plate, and so forth, of which is generally mountable to the backside of the device, whether it be temporarily or permanently attach to the electronic device. Handling accessories of these types may be equally adapted for integration within a structure of a protective cover aptly suited for the electronic device, such protective cover being particularly formed to protect the majority of the device's outer surfaces from scratches and inconsequential drops.

Although each of the foregoing handling accessories may adequately perform within the scope their individual design specifications, most are inept in addressing a host of multiple functionalities, which may be of particular importance or concern to a select number of end users. For example, some handling accessories recognized in the art may solely function as a mechanism for secure handling of the electronic device, but equally incapable of sufficing as an adjustable, supportable stand, and contrarily, as a supportable stand, but not as a compact handling mechanism. Furthermore, the ability to readily attach the electronic device with its accompanying handling accessory to nearby structural objects, such as one of many belt loops generally existing along one's waistline, a handle of a carrying tote bag or purse, and like personal structures, may be lacking within the scope of its inherent design specifications. A number of prior art handling accessories exemplify typical underperforming design characteristics briefly noted above, such as U.S. Pat. No. D866,546 issued to Stillwell et al., where it is shown and described therein a hand grip generally suited for attachment to the backside of a cellular phone and including in part a collapsible ring that advances secure hold of the cellular phone to the user's hand. Other representations possessing similar operating characteristics are well known in the art, including the protective electronic device holder shown and described in U.S. Pat. No. D866,546 issued to Cho, where an annular holding part attaches to and, in some embodiments, detaches from a base plate, with provisions to allow coupling with a user's finger as well as sufficing as a supportive stand for an electronic device while situated on a planar surface, albeit somewhat limited in terms of overall, angular adjustability.

Accordingly, there remains a need for a multi-positional clip accessory that is adaptable for use with most electronic devices available in the art and having structural characteristics that advances secure hold of the electronic device in varied environments as well as a supportive stand with capabilities for angular adjustability when resting atop of a planar surface, with provisions for readily attaching to structural objects associated with the end user or operating alternatively as a device for organizing electric cords along a wall surface, if so desired.

BRIEF SUMMARY OF THE INVENTION

In order to overcome the numerous drawbacks apparent in the prior art, a multi-positional clip accessory has been devised for readily attaching to and conjunctively operating with a variety of portable electronic devices, including, but not limited to, cellular telephones, tablets, gaming devices, as well as non-electronic devices, generally in the form of a book, writing pad or tablet and so forth.

It is an object of the present invention to provide a multi-positional clip accessory that offers a range of angular adjustability upon its use as a supportive stand for an electronic device of the particular type generally noted herein.

It is yet another object of the present invention to provide a multi-positional clip accessory that readily fulfills connection to external structural objects often accompanying a user of electronic devices, such structural objects generally being of the type associated with one's wearable clothing as well as carried accessories in the form of a tote bag, purse and the like.

It is a further object of the present invention to provide a multi-positional clip accessory capable of alternative uses besides that of a holding device and supporting stand for electronic devices, such as routing and supporting electrical cords and so forth along a wall surface to advance organization thereof and fulfill safety concerns, for example.

In accordance with the present invention, a multi-positional clip accessory has been devised for attachment to surfaces of electronic and non-electronic devices or planar surfaces in general to facilitate handling of the device, organizing wires and the like along a wall's surface, for example, and suspending and hanging structural aspects of personal articles, the multi-positional clip accessory includes a base configured with a cylindrical support longitudinally orientated and mounted to the base and having an interior cylindrical chamber for housing therein a rotatable rod with first and second ends affixed to lower portions of first and second pivoting arms, each of the first and second pivoting arms including an upper portion formed as an overhang respectively configured with a catch and a pair of inline apertures constituting a mountable end for accepting terminal ends of a spring clip configured with a free end that operatively interacts with the catch, the rotatable rod incudes a plurality of splines geometrically corresponding to a plurality of linear grooves configured within semi-radial sidewalls of the interior cylindrical chamber with the semi-radial sidewalls being formed in part by an elongate opening extending lengthwise about the cylindrical support, whereby applying a minute amount of force to the pivoting arms causes the rotatable rod to rotate about its longitudinal axis within the interior cylindrical chamber while simultaneously expanding the semi-radial sidewalls outwardly and widening the elongate opening a predetermined amount as the splines release from their mating relation with the linear grooves and re-engage with neighboring linear grooves upon the release of the force to finally establish an altered angular relationship of the pivoting arms relatively to the base.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a multi-positional clip accessory capable of being readily attached to and detached from electronic and non-electronic devices without adversely impacting their inherent structures and operating capabilities.

Figure 1:
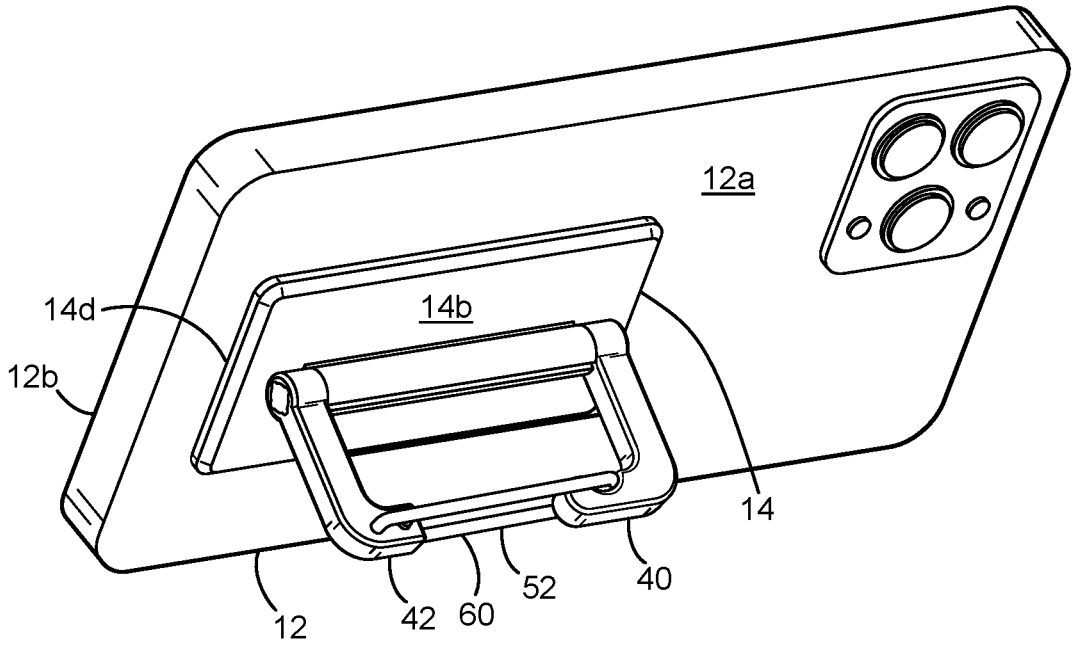
FIG. 1 is a rear perspective view of the preferred embodiment of the present invention illustrating a base mounted to an exterior surface of a cellular telephone and configured with a cylindrical support and first and second pivoting arms.
Figure 2:
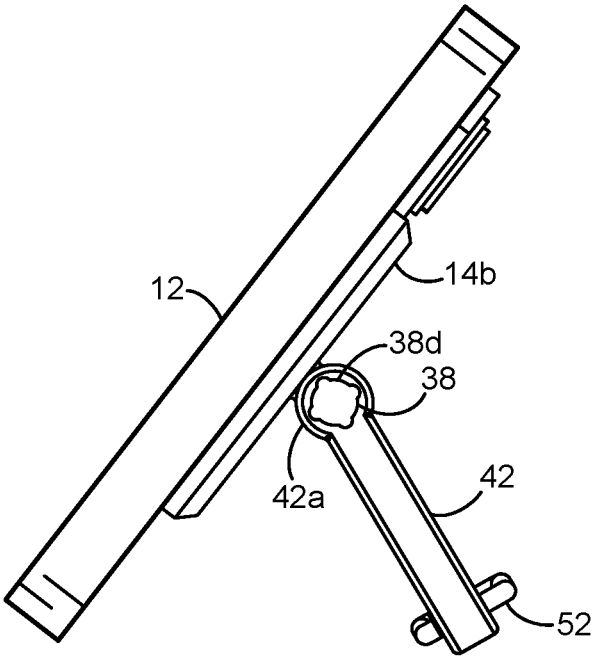
FIG. 2 is an end view of the preferred embodiment of the present invention illustrating a base mounted to an exterior surface of a cellular telephone and first and second pivoting arms angularly orientated to support the cellular telephone.
Figure 3:
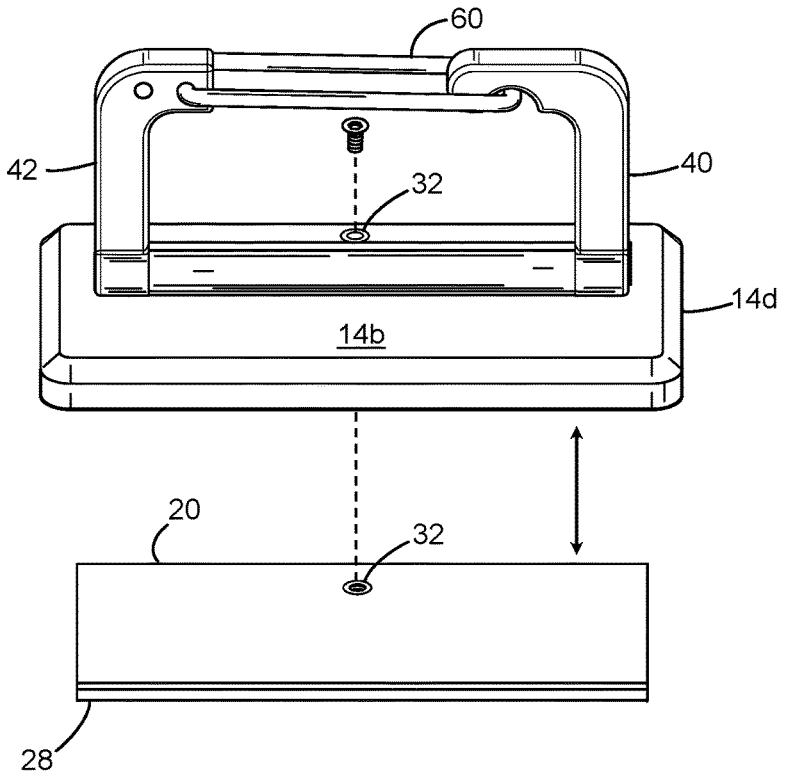
FIG. 3 is a top exploded view of an alternative embodiment of the present invention illustrating a mount plate separable from a base and a set screw for affixing the mount plate within an inset.

Referring now to FIGS. 1-2, there is shown generally at 10 a multi-positional clip accessory exemplarily positioned on and attached to a cellular telephone 12 of the type readily available and known in the art. The multi-positional clip accessory in particular comprises a base 14, representative of a first embodiment thereof, having a bottom side 14*a* designated for engaging and attaching to an exterior surface 12*a* of a non-electronic or an electronic device, such for example the cellular telephone 12 of the type shown in FIGS. 1 and 2, or a planar surface in general, such as a building's wall and the like, and a top side 14*b* configured with a cylindrical support 16 extending longitudinally about the base and attaching midway in between the base's lengthened and shortened sidewalls 14*c*, 14*d*.

Figure 4:
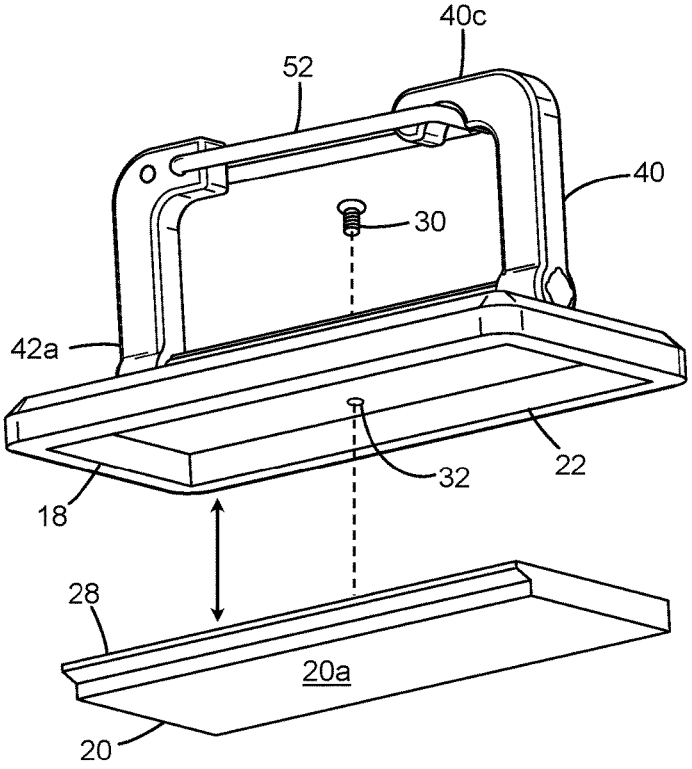
FIG. 4 is a bottom exploded view of the alternative embodiment of the present invention illustrating a mount plate separable from a base and having a tapered extending offset.
Figure 5:
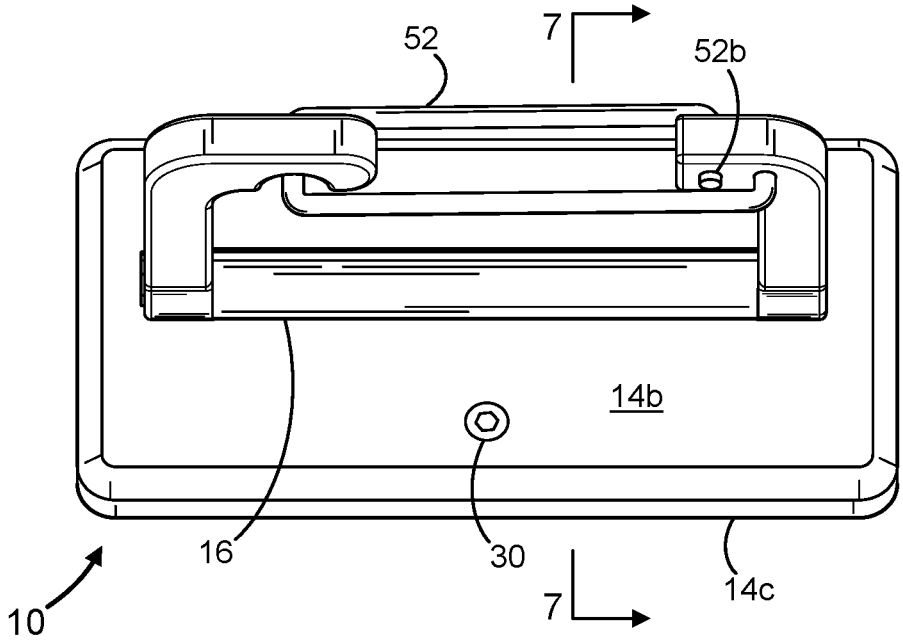
FIG. 5 is a top perspective view of the alternative embodiment of the present invention illustrating a first and second pivoting arms attached to a rotatable rod housed within a cylindrical support connecting to a base with a mount plate affixed thereto by a set screw.
Figure 6:
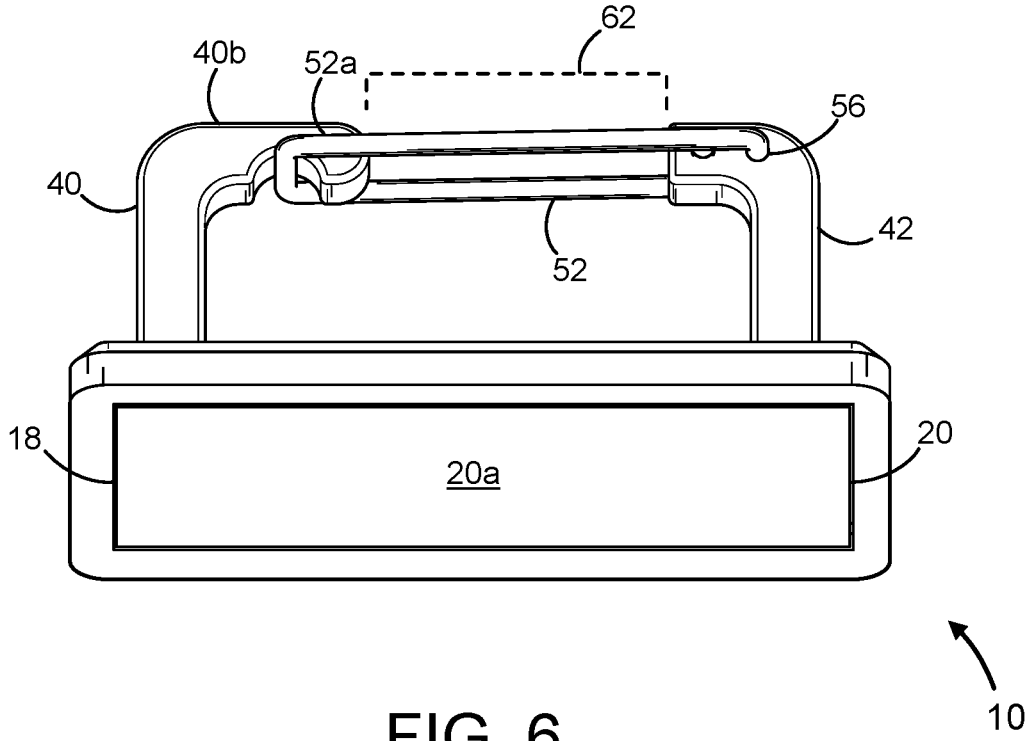
FIG. 6 is a bottom perspective view of the alternative embodiment of the present invention illustrating a mount plate fitting within an inset integral to a base.
Figure 7:
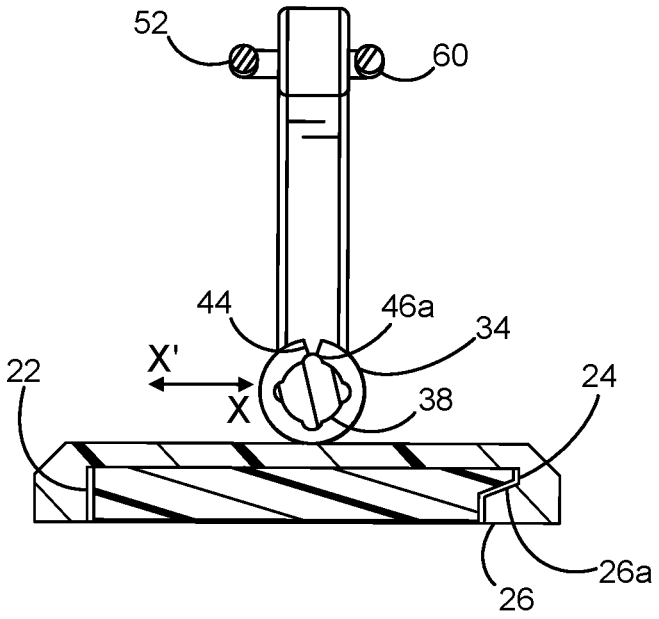
FIG. 7 is a cross sectional view of the alternative embodiment of the present invention taken along line 7-7 in FIG. 5 illustrating a mount plate fitting within an inset having an internal sideward recess.

In an alternative, second embodiment of the base 14, which is equally fitted with the cylindrical support 16 as in FIGS. 3-8, the bottom side 14*a* incorporates connectivity means, which comprises an inset 18 extending inwardly into the base for accommodating therewithin a mount plate 20 of approximate geometric configuration. The mount plate in this regard is capable of being fixedly attached to the exterior surface 12*a* of the non-electronic or an electronic device or a planar surface in general, with further provisions of being readily attached and detached from the base to provide for limited removal of the multi-positional clip accessory 10 from the device or surface when not in use or needed in certain circumstances. FIGS. 4 and 6 illustrates the inset 18 as having an accessible portion 22 in open communication with an internal sideward recess 24, which is formed in part by an overhang 26 configured with a tapered inner wall 26*a*. Conversely, as in FIG. 3, the mount plate includes one side configured with a tapered extending offset 28 substantially having equal geometric proportions to the internal sideward recess, whereby fitment of the mount plate 20 within the inset is fulfilled by angularly positioning the mount plate and slidably inserting the tapered extending offset into the internal sideward recess 24 and pushing downwardly on the mount plate into the accessible portion 22, particularly as such to allow a surface-mounting side 20*a* of the mount plate to substantially sit evenly with the bottom side 14*a* of the base, as generally shown in FIGS. 6 and 7. After engagingly locking the tapered extending offset 28 into the internal sideward recess to the likes depicted in FIGS. 7 and 8, consummating connectivity means includes threadably fitting a set screw 30 within an aligned arrangement of threaded bores 32 extending through the base and terminating within the mount plate 20.

Figure 9:
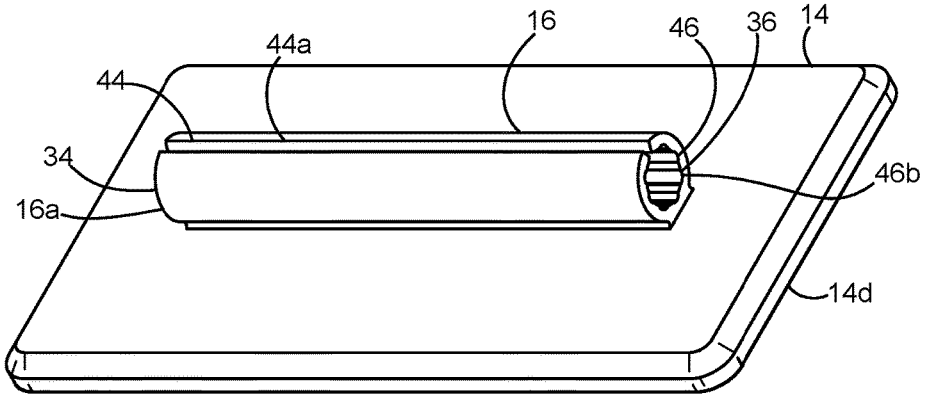
FIG. 9 is a front perspective view of the preferred embodiment of the present invention illustrating a cylindrical support longitudinally orientated and mounted to a base.
Figure 10:
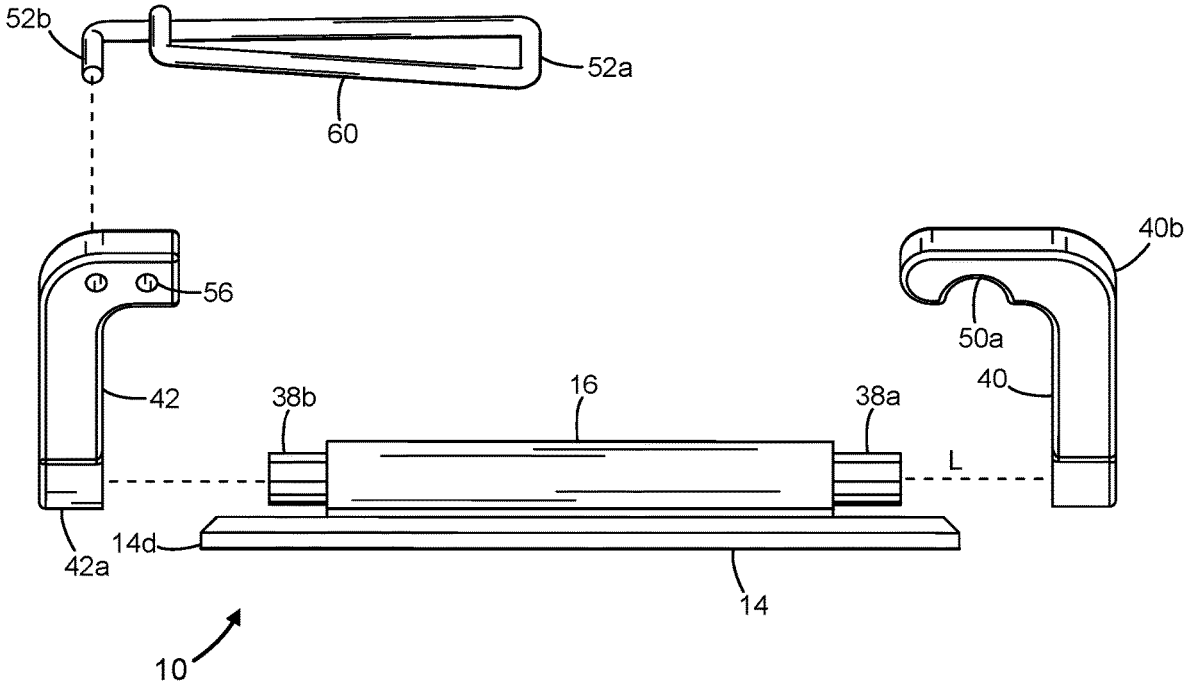
FIG. 10 is an exploded view of the preferred embodiment of the present invention illustrating first and second pivoting arms separable from a spring clip and a base configured with cylindrical support housing a rotatable rod.

The cylindrical support 16 is further illustrated in FIGS. 9 and 10 as comprising a pair of semi-radial sidewalls 34 substantially forming an interior cylindrical chamber 36 for spatially accommodating therein a rotatable rod 38 with first and second ends 38*a*, 38*b* thereof extending a predetermined amount beyond ends 16*a* of the cylindrical support to effect mounting of first and second pivoting arms 40, 42 respectively thereto. The cylindrical support 16 is further featured with locking means to allow for semi-permanent locking of the rotatable rod 38 at pre-select radial intervals. Locking means, in its operative capacity, is depicted in FIG. 9 as comprising an elongate opening 44 extending relatively about the length of the cylindrical support with a predetermined width 44*a* and a plurality of linear grooves 46 extending lengthwise and spaced equally about the interior cylindrical chamber 36 of the cylindrical support, with one of the linear grooves 46*a* notably coinciding with and existing below the elongate opening, as in FIG. 7.

Figure 11:
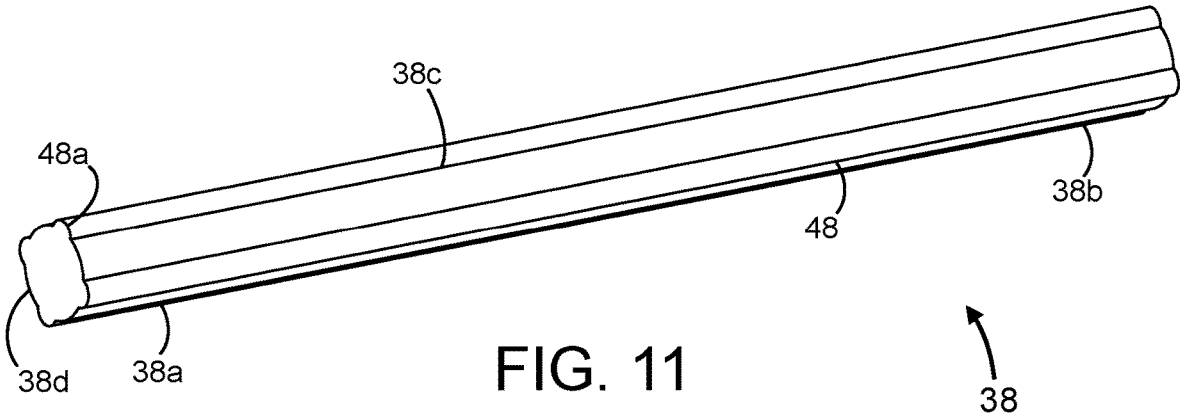
FIG. 11 is a front perspective view of the preferred embodiment of the present invention illustrating a rotatable rod having a plurality of splines and first and second ends.

In further association with locking means, the rotatable rod 38, as in FIG. 11, comprises a plurality of splines 48 integrally extending outwardly from and being spaced evenly about its exterior circumferential surface 38*c*, wherein the number of splines may be less or equal to the number of linear grooves 46 with each of the splines possessing a geometric profile substantially capable of engagingly fitting within the linear grooves of the interior cylindrical chamber 36. In fulfilling radial adjustability of the rotatable rod with adaptation and use of locking means, it is desirable that each of the linear grooves of the interior cylindrical chamber of the type shown in FIGS. 7 and 9 possesses an inward rounded appearance or concave geometric cross profile 46*b* extending entirely about its length, while each of the splines possesses an outward rounded appearance or convex geometric profile 48*a* equally extending about its length. By and through the geometric arrangement of the linear grooves and splines associated with locking means, the rotatable rod 38 can be set to a new radial interval with relative ease by simply manually manipulating or turning the rotatable rod about its longitudinal axis L in FIG. 10, during which time the semi-radial sidewalls 34 of the cylindrical support 16 will appreciably expand outward to moveable state X' in FIG. 7, while the elongate opening 44 widens a predetermined amount to allow the splines to aptly disengage from their corresponding linear grooves and bypass neighboring linear grooves to finally rest within and engage a new set of linear grooves, with the semi-radial sidewalls resiliently returning to static state X in FIG. 7.

Although the geometric profiles of the linear grooves and splines notably fulfill the primary operative objectives of the multi-positional clip accessory 10, locking means may incorporate linear grooves and splines comprising other or alternative geometric profiles that may equally suffice in this regard, such as those that may have a V-shaped profile or equivalent profile types that possess the capability of being readily disengaged from their mating relation to the likes described herein.

Figure 12:
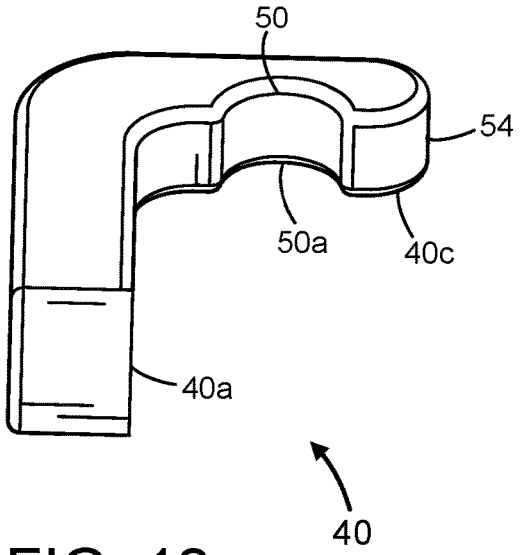
FIG. 12 is a bottom perspective view of the preferred embodiment of the present invention illustrating a first pivoting arm having lower and upper portions.
Figure 13:
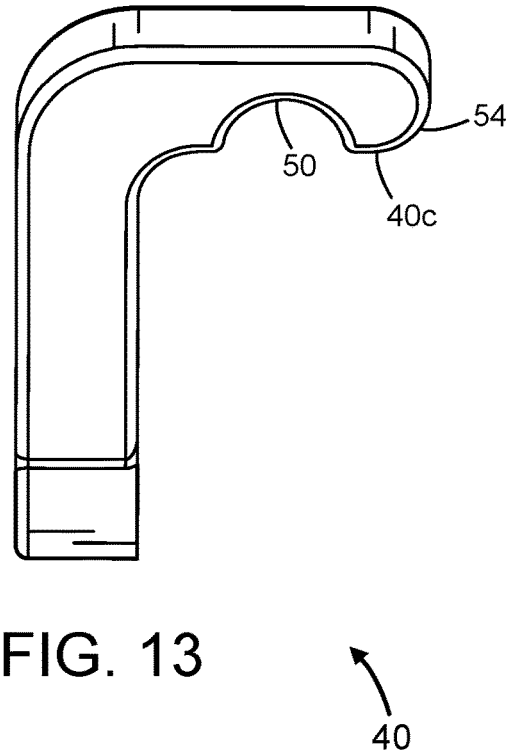
FIG. 13 is a top perspective view of the preferred embodiment of the present invention illustrating a first pivoting arm having a lower portion and an upper portion formed as an overhang configured with a catch.
Figure 14:
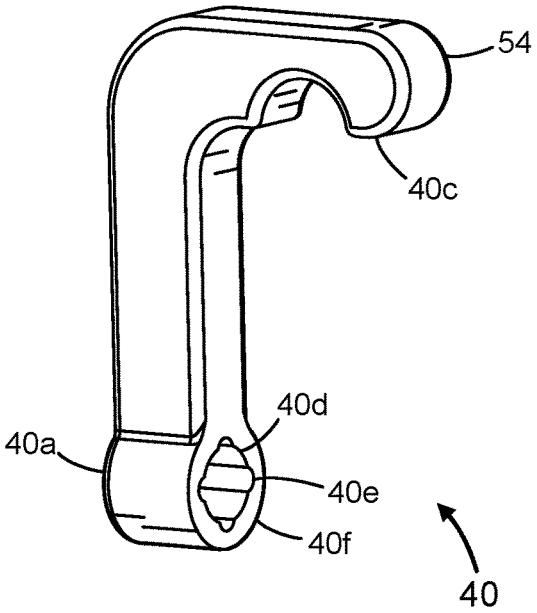
FIG. 14 is a front perspective view of the preferred embodiment of the present invention illustrating a first pivoting arm having a lower portion configured with an aperture having linear grooves and an upper portion configured with a catch.
Figure 15:
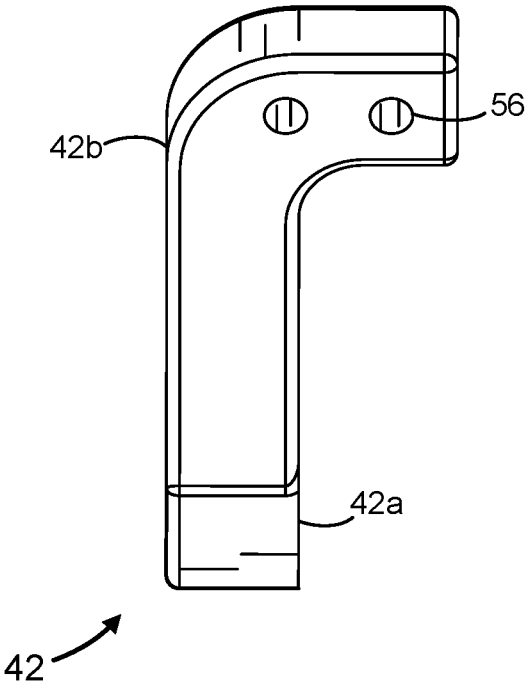
FIG. 15 is a front perspective view of the preferred embodiment of the present invention illustrating a second pivoting arm having a lower portion and an upper portion formed as an overhang configured with a pair of inline apertures.
Figure 16:
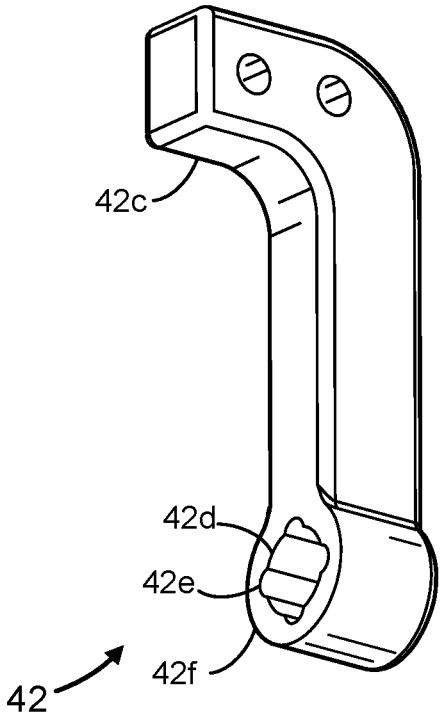
FIG. 16 is a bottom perspective view of the preferred embodiment of the present invention illustrating a second pivoting arm having a lower portion configured with an aperture having linear grooves and an upper portion configured with a pair of inline apertures.
Figure 17:
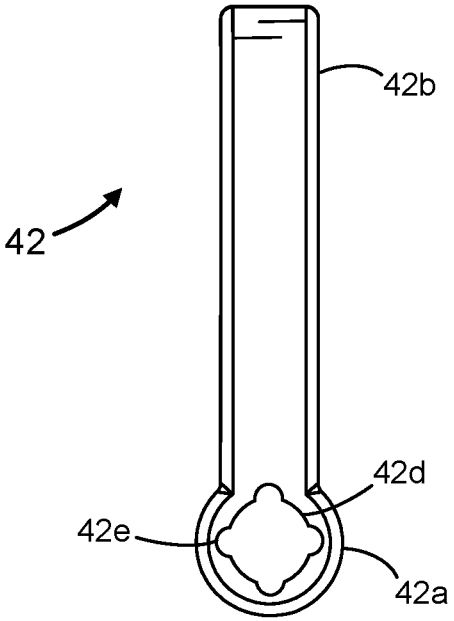
FIG. 17 is a side view of the preferred embodiment of the present invention illustrating a first pivoting arm having a lower portion configured with an aperture having linear grooves.

Now in reference to FIGS. 12-17, each of the pivoting arms 40, 42 shown therein comprises a lower portion 40*a*, 42*a* integrally connecting to an upper portion 40*b*, 42*b* configured with an overhang 40*c*, 42*c* to form an overall shape generally resembling the letter "L" in an inverted orientation. In FIGS. 14 and 16, an aperture 40*d*, 42*d* is shown as extending through the lower portion of each of the pivoting arms to receive and accommodate therewithin the ends 38*a*, 38*b* of the rotatable rod, wherein each of the apertures comprises linear grooves 40*e*, 42*e* to the likes associated with the cylindrical support, with each equally being configured with a concave geometric profile or any desirable profile that may be associated with the rotatable rod. The number of linear grooves in association with the aperture will preferentially equate to and correspond with the number of splines of the rotatable rod, such as a set of four linear grooves and splines generally depicted in FIGS. 11, 14 and 16. Because the functionality of the linear grooves present within the aperture differs from that of the cylindrical support, such to prevent slippage and the like or to facilitate ease of manufacture, it is understood within the scope of the present invention that varied geometric profiles and any number of linear grooves may suffice in connecting the first and second pivoting arms respectively to the first and second ends of the rotatable arms 38, providing that the rotatable rod is equally configured to the same degree to allow for connectivity. For example, it is conceivable that each of the first and second ends 38*a*, 38*b* of the rotatable rod may be aptly configured with a geometric profile that differs from that used for locking means, providing that connectively is maintained with that of the pivoting arms 40, 42. Regardless of the geometric profile and number of linear grooves, it is desirable in most instances that the end of the rotatable rod is tightly fitted within the aperture and fixedly attached thereat by an application of adhesive, glue and so forth. Other connectivity options of the pivoting arms to the rotatable rod, besides that of a splined relation described hereinbefore, may comprise a keyway relationship of the type generally known in the art or a set screw or equivalent form of fastener extending through a curved wall 40*f*, 42*f* forming the aperture and terminating within and penetrating into the end of the rotatable rod.

As further illustrated in FIGS. 12-14, the overhang 40*c* of the first pivoting arm 40 comprises a catch 50 for receiving a free end 52*a* of a spring clip 52, with the catch generally possessing a semi-circular or arcuate-shaped configuration facing open, directionally towards the top side 14*b* of the base 14. The overhang of the first pivoting arm may be supplemented with an inward end 54 having a bullnose or rounded profile to eliminate unwanted or inadvertent snagging of structural aspects associated with personal articles and the like during use of the multi-positional clip assembly 10. Comparatively, the overhang 42*c* of the second pivoting arm 42, as in FIGS. 15-17, comprises a pair of inline apertures 56 for receiving terminal ends 52*b* of the spring clip, wherein the inline apertures generally exist in a collinear relation with the catch's apex 50*a* to maintain a near parallel relationship of the spring clip 52 with that of the base 14 while in a static, mounted state, as primarily shown in FIGS. 3 and 4.

Figure 18:
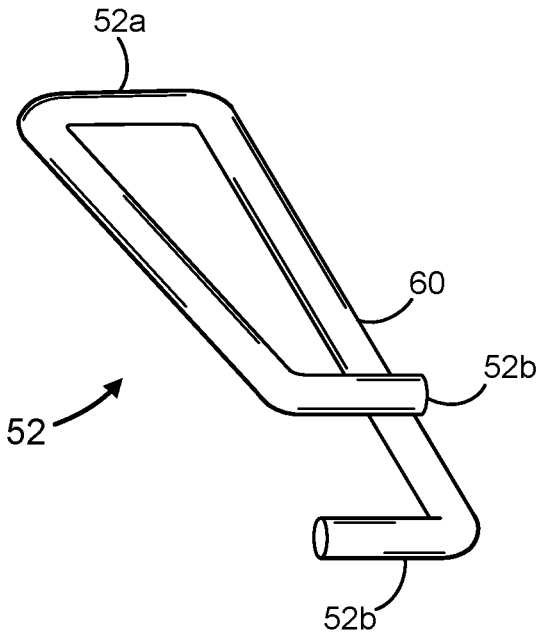
FIG. 18 is a top perspective view of the preferred embodiment of the present invention illustrating a spring clip having terminal ends and a free end.

The spring clip is generally depicted in FIGS. 10 and 18 as possessing a near overall rectangular configuration with the free end being squared, or alternatively rounded and like geometries to effectively engage with the catch with adequate spatial clearance, whereas as the terminal ends, generally constituting a mountable end 58, are arranged in an offsetting manner to establish a predetermined amount of inherent tension to the structure of the spring clip. As can be seen in FIG. 18, linear members 60 connecting the free end to the terminal ends and forming in part the spring clip are angularly orientated with respect to one another and when positioned to exist substantially on the same plane, as in the case where the mountable end 58 is attached to the overhang 42*c* of the second pivoting arm 42, the requisite tension is foundationally present within the spring clip 52.

Figure 8:
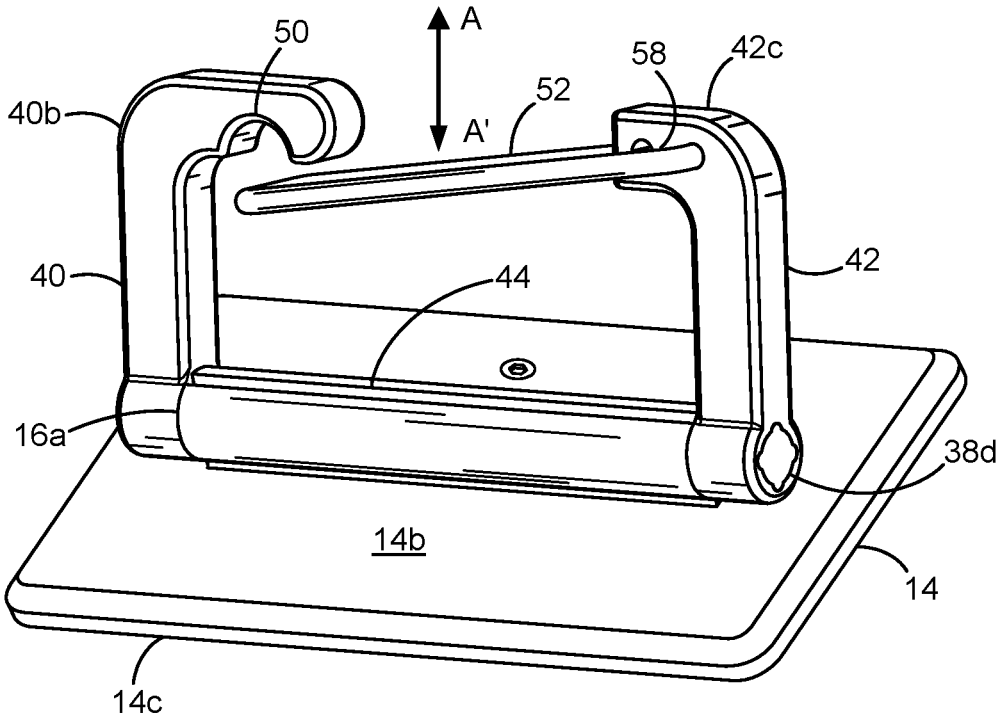
FIG. 8 is a front perspective view of the alternative embodiment of the present invention illustrating first and second pivoting arms attached to a base having a cylindrical support and a free end of a spring clip downwardly displaced from a catch.

In a general sense of attributes of functionality, the angular offset of the terminal ends 52*b* of the spring clip, the effective diameter or thickness of the linear members 60, and physical properties of the material of fabrication, provide for the spring clip's modest amount of resiliency, particularly more so as a minute amount of force is applied downwardly in the direction A' in FIG. 8, whereupon immediate release of the force allows the free end 52*a* of the spring clip to move upwardly in the direction A and re-engage with the catch 50, thus returning the spring clip to its near parallel static state. Consistent with the general structural makeup of the spring clip and its arrangement relatively to the pivoting arms, the free end of the spring clip is capable of being moved laterally a predetermined amount such to allow it to bypass the overhang 40*c* of the first pivoting arm, free from engaging the catch and move upwardly from and exist above the overhang, thus effectively opening up a portion of a midsection 62 that inherently exists in between the overhangs of the first and second pivoting arms to spatially accommodate or accept therethrough structural aspects of personal articles and the like.

Now by way of briefly describing the assembly and operation of the multi-positional clip accessory 10, one may appreciably gain further insight into the relatedness and interaction of the operative components discussed thus far that principally fulfill the utilitarian objects of the present invention.

The rotatable rod 38 is initially assembled by orientating the linear grooves of the interior cylindrical chamber 36 with the splines 48 of the rotatable rod and slidably advancing the rotatable rod to the extent of establishing its center position, notably where the ends 38*a*, 38*b* of the rotatable rod extend equidistant from the ends of the cylindrical support 16. Comparatively, the first and second pivoting arms 40, 42, as orientated as pair on the same plane, are respectively mounted to the first and second ends of the rotatable rod by matching the linear grooves integral to the apertures of the pivoting arms with the splines of the rotatable rod, applying adhesive or equivalent to the ends of the rotatable rod, and slidably positioning the pivoting arms until sitting evenly with the individual surface ends 38*d* of the rotatable rod. Finally, the terminal ends 52*b* of the spring clip are pressed fitted within the inline apertures 56 of the second pivoting arm, whereby the free end 52*a* of the spring clip is positioned to engage the catch 50 of the first pivoting arm.

Figure 19:
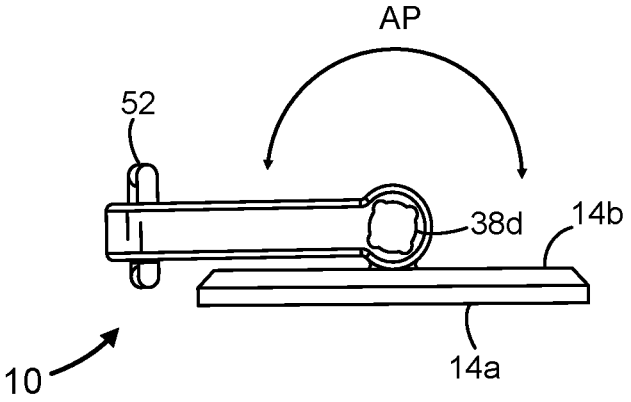
FIG. 19 is an end view of the preferred embodiment of the present invention illustrating first and second pivoting arms in a folded-down relation relatively to a base mountably configured with a cylindrical support.
Figure 20:
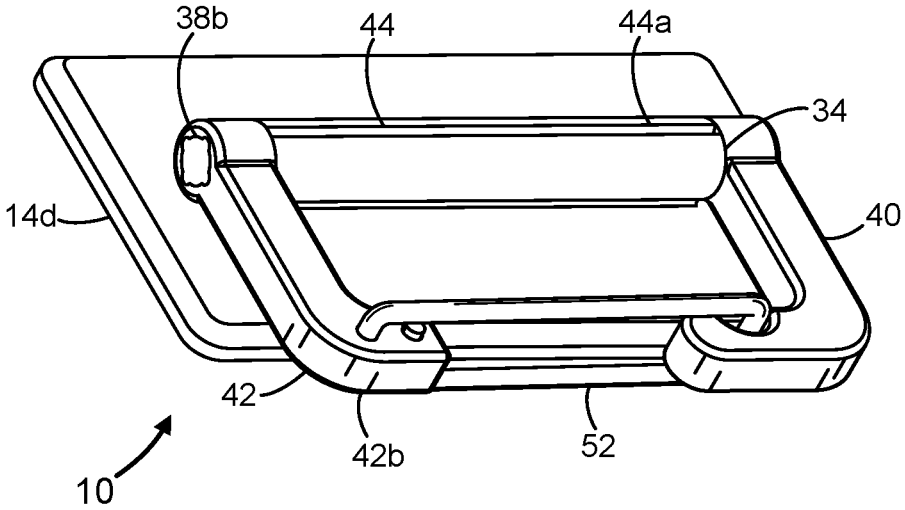
FIG. 20 is top perspective view of the preferred embodiment of the present invention illustrating first and second pivoting arms in a folded-down relation relatively to a base mountably configured with a cylindrical support.
Figure 21:
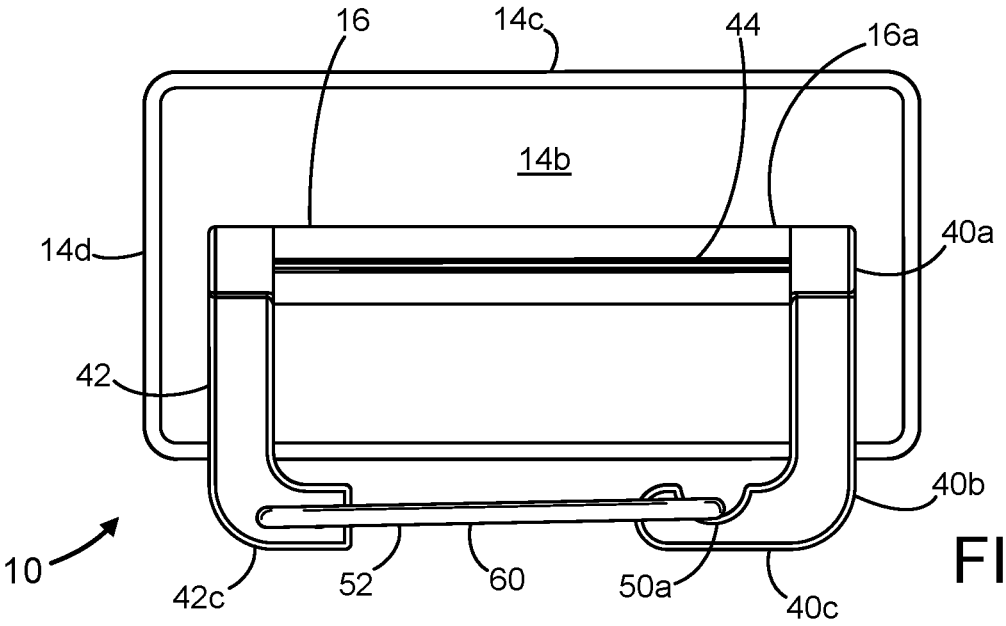
FIG. 21 is a top plan view of the preferred embodiment of the present invention illustrating first and second pivoting arms positioned about ends of a cylindrical support having an elongate opening extending lengthwise thereabout.

In further aspects of assembly, the multi-positional clip accessory 10, particularly in relation to use with electronic and non-electronic devices, the bottom side of the base or the surface-mounting side of the mount plate 20 is aptly configured with adhesive, a hook-and-loop fastener or preferably, with double-side tape. In most instances of using the multi-positional clip accessory, as in FIG. 1, the base 14 is positioned and mounted centrally along the electronic device's longitudinal axis and in close proximity to an end 12*b* of the electronic device to provide for overall stability while being used in a vertical or portrait orientation or alternatively in a horizontal or landscape orientation. Angular adjustability of the pivoting arms is simply advanced by manual manipulation of one of the pivoting arms directionally along angular path AP in FIG. 19, whereupon the application of applied force to the pivoting arms will momentarily yield outward expansion of the semi-radial sidewalls 34 of the cylindrical support 16 while widening the width 44*a* the elongate opening 44 as the splines 48 of the rotatable rod 38 radially traverse and come full seated in a new set of linear grooves 46 to engagingly lock the pivoting arms at the new radial interval, as generally illustrated in FIGS. 20 and 21.

It is obvious that the components comprising the multi-positional clip accessory 10 may be fabricated from a variety of materials, providing such selection or use of materials possess the capacity to withstand forces acting thereon throughout its duration of use, perhaps in an office setting or outdoor environment.

Accordingly, it is most desirable, and therefore preferred, to construct the base 14 and pivoting arms 40, 42 from plastic, aluminum, polymer composites, or an equivalent type of material that meaningfully offers reasonable structural strength for its weight, while limiting the extent by which the components may unacceptably fail due to applied forces acting thereon. In other aspects of fabrication, the rotatable rod 38 is extruded, machined or 3D printed with the desired number of splines using aluminum, carbon steel, polymer composites, or equivalent types of materials to fulfill the requisite requirements of strength and light weight for everyday use.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention. For instance, the pivoting arms may differ in size, aesthetics and perhaps in form to fulfill certain conditions or requirements of use, such as to effectively managed loads from heavy-weighted items that may be used conjunctively with the multi-positional clip accessory 10. Thus, the scope of the invention should be determined by the appended claims and their legal equivalents rather than by the examples set forth herein.

What is claimed is:

1. A multi-positional clip accessory for attachment to a surface, said accessory comprising, in combination:

a base having a top side and a bottom side for attaching to the surface;

a cylindrical support longitudinally orientating and mounting to said top side and having an interior cylindrical chamber;

a rotatable rod positioned within said interior cylindrical chamber and having a first end and a second end individually extending beyond each end of the cylindrical support;

a first pivoting arm having a lower portion fixedly attaching to said first end of the rotatable rod and an upper portion configured with a catch;

a second pivoting arm having a lower portion fixedly attaching to said second end of the rotatable rod and an upper portion; and a spring clip having a free end capable of engaging said catch and a mountable end attaching to said upper portion of the second pivoting arm.

2. The accessory as set forth in claim 1, wherein said cylindrical support comprises a pair of semi-radial sidewalls and locking means to allow for semi-permanent locking of said rotatable rod at pre-select radial intervals.

3. The accessory as set forth in claim 2, wherein said locking means comprises an elongate opening extending relatively about the length of said cylindrical support and a plurality of linear grooves extending lengthwise and spaced equally about said interior cylindrical chamber.

4. The accessory as set forth in claim 3, wherein said rotatable rod comprises a plurality of splines integrally extending outwardly from and being spaced evenly about an exterior circumferential surface of the rotatable rod, each of said splines having a geometric profile capable of seating within and engaging each of said linear grooves.

5. The accessory as set forth in claim 1, wherein said spring clip comprises a pair of linear members orientated in an angular manner with respect to one another while said mountable end comprises a pair of terminal ends positioned in an offsetting manner as to collectively establish inherent spring tension.

6. The accessory as set forth in claim 5, wherein said upper portion of the second pivoting arm comprises a pair of inline apertures for receiving therein said terminal ends of the spring clip.

7. The accessory as set forth in claim 4, wherein said lower portions of the first and second pivoting arms each comprises an aperture configured with linear grooves corresponding in number to the number of said splines of the rotatable rod.

8. The accessory as set forth in claim 1, wherein said upper portion of the first pivoting arm is formed with an overhang having an inward end configured with a rounded profile.

9. A multi-positional clip accessory for attachment to a surface, said accessory comprising, in combination:

a base having a top side and a bottom side, said bottom side having an inset configured with an accessible portion and an internal sideward recess;

a cylindrical support longitudinally orientating and mounting to said top side and having an interior cylindrical chamber;

a rotatable rod positioned within said interior cylindrical chamber and having a first end and a second end individually extending beyond each end of the cylindrical support;

a first pivoting arm having a lower portion fixedly attaching to said first end of the rotatable rod and an upper portion configured with a catch;

a second pivoting arm having a lower portion fixedly attaching to said second end of the rotatable rod and an upper portion; and a spring clip having a free end capable of engaging said catch and a mountable end attaching to said upper portion of the second pivoting arm.

10. The accessory as set forth in claim 9, furthering comprising a mount plate having a tapered extending offset capable of engagingly fitting within said internal sideward recess and a surface-mounting side for attaching to the surface, said mount plate and said base each having a threaded bore in an aligned arrangement for threadably receiving therein a set screw.

11. The accessory as set forth in claim 9, wherein said spring clip comprises a pair of linear members orientated in an angular manner with respect to one another while said mountable end comprises a pair of terminal ends positioned in an offsetting manner as to collectively establish inherent spring tension.

12. The accessory as set forth in claim 9, wherein said cylindrical support comprises a pair of semi-radial sidewalls and an elongate opening extending relatively about the length of said cylindrical support and a plurality of linear grooves extending lengthwise and spaced equally about said interior cylindrical chamber.

13. The accessory as set forth in claim 12, wherein said rotatable rod comprises a plurality of splines integrally extending outwardly from and being spaced evenly about an exterior circumferential surface of the rotatable rod, each of said splines having a geometric profile capable of seating within and engaging each of said linear grooves.

14. The accessory as set forth in claim 13, wherein said lower portions of the first and second pivoting arms each comprises an aperture configured with linear grooves corresponding in number to the number of said splines of the rotatable rod.

15. A multi-positional clip accessory for attachment to a surface, said accessory comprising, in combination:

a base having a top side and a bottom side for attaching to the surface;

a cylindrical support longitudinally orientating and mounting to said top side and having an interior cylindrical chamber, said cylindrical support having an elongate opening extending relatively about its length, said interior cylindrical chamber having a plurality of linear grooves extending lengthwise and spaced equally thereabout;

a rotatable rod positioned within said interior cylindrical chamber and having a first end and a second end individually extending beyond each end of the cylindrical support, said rotatable rod having a plurality of splines integrally extending outwardly from and being spaced evenly about an exterior circumferential surface of the rotatable rod;

a first pivoting arm having a lower portion fixedly attaching to said first end of the rotatable rod and an upper portion configured with an overhang having a catch;

a second pivoting arm having a lower portion fixedly attaching to said second end of the rotatable rod and an upper portion; and a spring clip having a free end capable of engaging said catch and a mountable end attaching to said upper portion of the second pivoting arm.

16. The accessory as set forth in claim 15, wherein said cylindrical support comprises a pair of semi-radial sidewalls formed in part by said elongate opening, whereby rotation of said rotatable rod about its longitudinal axis expands said elongate opening a predetermined amount as said splines of the rotatable rod relocate to and seat within neighboring linear grooves of said interior cylindrical chamber.

17. The accessory as set forth in claim 15, wherein said spring clip comprises a pair of linear members orientated in an angular manner with respect to one another while said mountable end comprises a pair of terminal ends positioned in an offsetting manner as to collectively establish inherent spring tension.

18. The accessory as set forth in claim 17, wherein said upper portion of the second pivoting arm comprises a pair of inline apertures for receiving therein said terminal ends of the spring clip, wherein said inline apertures substantially extend inline to an apex of the catch to establish a near parallel relationship between said spring clip and said base while said free end engages said catch.

19. The accessory as set forth in claim 15, wherein said lower portions of the first and second pivoting arms each comprises an aperture for respectively receiving therein said first and second ends of the rotatable rod, each of said apertures having linear grooves corresponding in number to the number of said splines of the rotatable rod.

20. The accessory as set forth in claim 15, wherein said upper portion of the first pivoting arm is formed with an overhang having an inward end configured with a rounded profile.

* * * * *